US006024191A

United States Patent [19]

Backer et al.

[11] Patent Number: 6,024,191

[45] Date of Patent: Feb. 15, 2000

[54] LIFT APPARATUS HAVING AN ARTICULATED DOUBLE PARALLELOGRAM BOOM ASSEMBLY

[75] Inventors: Robert Douglas Backer, Rouzerville, Pa.; Michael Francis Goodrich, Myersville, Md.

[73] Assignee: Kiddie Industries, Inc., Shady Grove, Pa.

[21] Appl. No.: 09/015,762

[22] Filed: Jan. 29, 1998

Related U.S. Application Data

[60] Provisional application No. 60/037,105, Jan. 31, 1997.

[51] Int. Cl.[7] ..... E06C 1/00

[52] U.S. Cl. ..... 182/69.6; 182/2.7; 182/2.11; 182/141

[58] Field of Search ..... 182/2.1, 2.2, 2.3, 182/2.4, 2.5, 2.6, 2.7, 2.8, 2.9, 2.11, 63.1, 69.6, 141

[56] References Cited

U.S. PATENT DOCUMENTS

| | | | |
|---|---|---|---|
| 3,132,718 | 5/1964 | Pierce, Jr. | 182/2.8 |
| 3,483,948 | 12/1969 | Thornton-Trump | 182/2.7 |
| 3,554,319 | 1/1971 | Smith | 182/2.9 |
| 3,768,591 | 10/1973 | Stucky et al. | 182/2.7 |
| 4,004,652 | 1/1977 | Laboy-Alvarado . | |
| 4,019,604 | 4/1977 | Benson . | |
| 4,053,075 | 10/1977 | Stedman | 182/2.8 X |
| 4,431,083 | 2/1984 | York . | |
| 4,624,340 | 11/1986 | Astrom et al. . | |
| 4,679,653 | 7/1987 | Pasquarette, Jr. et al. | 182/2.4 |
| 4,694,930 | 9/1987 | Kishi . | |
| 4,696,371 | 9/1987 | Moog . | |
| 4,757,875 | 7/1988 | Hade, Jr. et al. . | |
| 4,775,029 | 10/1988 | MacDonald et al. . | |
| 4,953,666 | 9/1990 | Riding . | |
| 5,129,480 | 7/1992 | Garrett et al. . | |
| 5,135,074 | 8/1992 | Hornagold . | |
| 5,249,643 | 10/1993 | Backer et al. | 182/2.11 |
| 5,253,731 | 10/1993 | Moog . | |
| 5,427,197 | 6/1995 | Waters | 182/2.9 |
| 5,584,356 | 12/1996 | Goodrich . | |

OTHER PUBLICATIONS

AB46 UpRight, UpRight Self–Propelled and Boom–Supported Lifts (pps. 15–16 of UpRight Marketing Brochure).

SJKB–33N by SKYJACK . . . the new breed!(Marketing Brochure).

Genie Z–30/20N Narrow Self–Propelled Articulating Boom (Marketing Brochure and photographs).

*Primary Examiner*—Daniel P. Stodola
*Assistant Examiner*—Richard M. Smith
*Attorney, Agent, or Firm*—Birch, Stewart, Kolasch & Birch, LLP

[57] ABSTRACT

A lift apparatus includes a superstructure frame support, a riser, and an articulated parallelogram boom assembly operatively connected between the superstructure frame support and the riser. The articulated parallelogram boom assembly includes a floating frame, a lower parallelogram boom assembly operationally connected between the superstructure frame support and the floating frame, an upper parallelogram boom assembly operationally connected between the floating frame and the riser, and a lift mechanism for raising and lowering the articulated parallelogram boom assembly. The lower parallelogram boom assembly, the upper parallelogram boom assembly, and the lift mechanism are formed such that the maximum extension height of the articulated parallelogram boom assembly is increased without an increase in the height of the articulated parallelogram boom assembly when lowered.

36 Claims, 9 Drawing Sheets

LIFT APPARATUS HAVING AN ARTICULATED DOUBLE PARALLELOGRAM BOOM ASSEMBLY

This application claims priority on provisional application Ser. No. 60/037,105 filed on Jan. 31, 1997 the entire contents of which are hereby incorporated by reference.

BACKGROUND OF THE INVENTION

1. Field of the Invention

The present invention relates to a lift apparatus; and more particularly, to a lift apparatus, such as an aerial work platform, having an articulated double parallelogram boom assembly.

2. Description of Related Art

A vehicular low profile self propelled aerial work platform is disclosed in U.S. Pat. No. 4,757,875, owned by the Assignee of the instant application, wherein a work platform is mounted on the distal end of a telescopic boom assembly having its proximate end pivotally connected to a floating or riser frame assembly which, in turn, is connected to a support frame on the vehicle by a pair of parallel arms, whereby the telescopic boom assembly and associated work platform can be extended to an operative position and folded to a lowered position, so that the vehicle can be maneuvered in warehouses or manufacturing plants having nine foot high doorways.

An articulated parallelogram assembly for elevating a work platform is disclosed in U.S. Pat. No. 5,129,480, also owned by the Assignee of the instant application, wherein a lower boom assembly having parallel compression and tension arms, offset from the centerline of the vehicle, are pivotally connected between a floating or riser frame assembly and the vehicle frame. An upper boom assembly is also provided wherein parallel compression and tension arms, offset from the centerline of the vehicle, are pivotally connected between the platform frame and the floating frame.

Another vehicular low profile, self-propelled aerial work platform having an articulated parallelogram boom assembly is disclosed in U.S. Pat. No. 5,584,356, also owned by the Assignee of the instant application, and is hereby incorporated by reference. The articulated boom assembly includes a lower boom assembly having pairs of compression and tension arms pivotally connected between a support frame on the vehicle and a floating frame, and an upper boom assembly having pairs of compression and tension arms pivotally connected between the floating frame and a riser connected to the proximate end of a telescopic boom assembly having a work platform connected to the distal end thereof. The ends of the tension arms in the upper and lower boom assemblies, which are pivotally connected to the floating frame, share the same pivot connection so that when the articulated parallelogram is in the folded position, the tension arms are inter-digitated and lie in the same common plane so that the vehicle can be maneuvered through a low doorway, in the order of six feet, seven inches. A synchronization linkage is mounted in the floating frame and connected between the pairs of compression arms in the upper and lower boom assemblies for maintaining the floating frame in a vertical orientation during the elevating and folding of the articulated parallelogram boom assembly.

While the self propelled aerial work platforms disclosed in the aforementioned patents have been satisfactory for their intended purposes, certain features contained in these self propelled aerial work platforms are employed in the low profile self propelled aerial work platform of the present invention to provide a new combination of components; whereby the telescopic boom assembly can be folded to a lowered position so that the vehicle can be maneuvered through standard height six foot, seven inch doorways.

SUMMARY OF THE INVENTION

One object of the present invention is to provide a lift apparatus, such as an aerial work platform, having a greater maximum working height without increasing the retracted height.

A further object of the present invention is to provide a lift apparatus having no tail swing and minimal front swing.

Another object of the present invention is to provide a lift apparatus having an articulated parallelogram boom assembly with downward sloping upper and lower boom assemblies when fully lowered.

An additional object of the present invention is to provide a lift apparatus having a single, vertically oriented, hydraulic cylinder for raising and lowering an articulated parallelogram boom assembly of the lift apparatus.

A still further objective of the present invention is to provide the upper and lower boom assemblies of the articulated parallelogram boom assembly and the hydraulic cylinder such that they are in-line (i.e., the longitudinal axes thereof lie within the same plane).

Another objective of the present invention is to provide a lift apparatus having an articulated parallelogram boom assembly wherein the geometry of the hydraulic cylinder and the synchronization links in the articulated parallelogram boom assembly minimize the load on the hydraulic cylinder and the synchronization links.

A further objective of the present invention is to provide a lift apparatus having an articulated parallelogram boom assembly wherein the geometry of the hydraulic cylinder and the synchronization links in the articulated parallelogram boom assembly cause the load on the hydraulic cylinder and the synchronization links to remain substantially constant throughout the working range of the articulated parallelogram boom assembly.

These and other objects are achieved providing a lift apparatus, comprising a superstructure frame support; a riser; an articulated parallelogram boom assembly operatively connected between said superstructure frame support and said riser, said articulated parallelogram boom assembly including, a floating frame, a lower parallelogram boom assembly operationally connected between said superstructure frame support and said floating frame, an upper parallelogram boom assembly operationally connected between said floating frame and said riser, lift means for raising and lowering said articulated parallelogram boom assembly, and said lower parallelogram boom assembly, said upper parallelogram boom assembly and said lift means formed such that a maximum extension height of said articulated parallelogram boom assembly is increased without an increase in a height of said articulated parallelogram boom assembly when fully lowered.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENT

Figure 1:
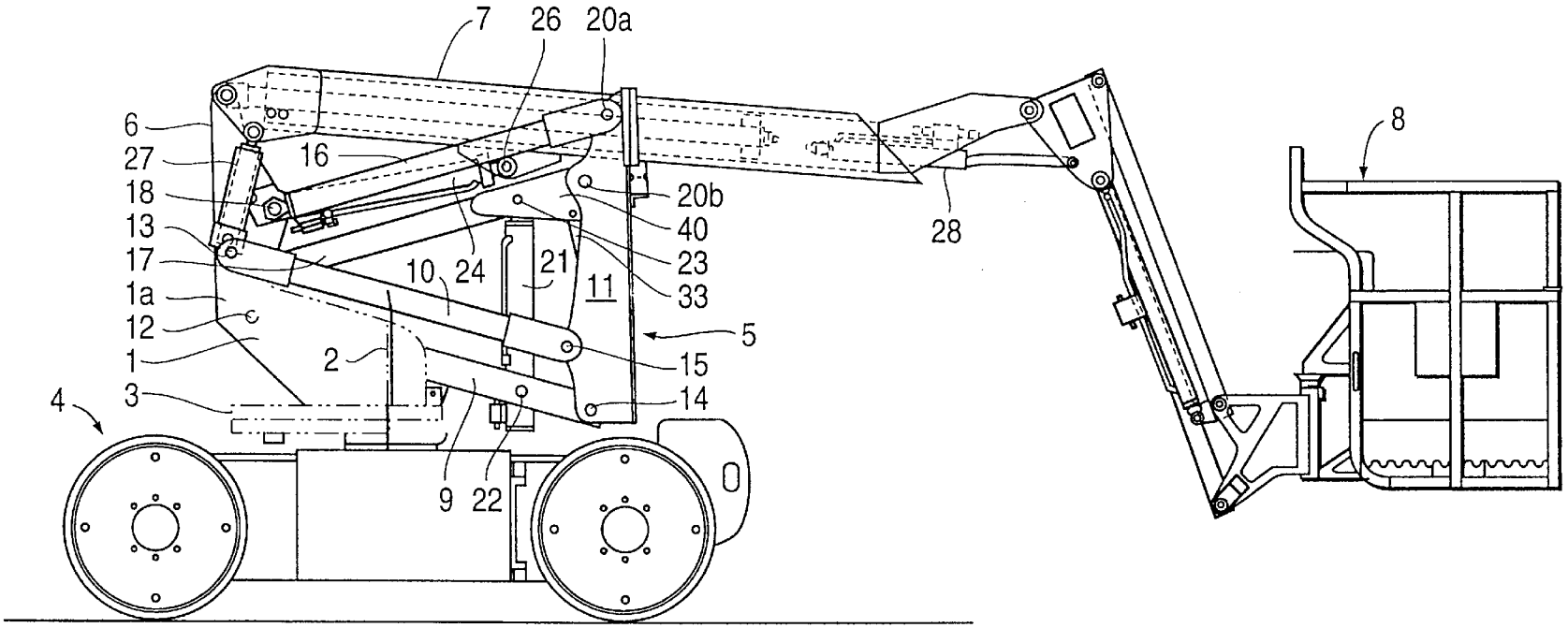
FIG. 1 is a side elevational view of a mobile aerial work platform showing the double parallelogram riser assembly according to the invention in a fully lowered position.

Referring to the drawings, and more particularly to FIGS. 1–4*b*, a low profile self propelled aerial work platform representing an embodiment of the present invention includes a super-structure support frame 1, having vertically extending plates 2 upon which counterweights, not shown, are adapted to be mounted. The support frame 1 is mounted on a turntable 3 carried by a vehicle chassis 4. An articulated parallelogram boom assembly 5 is operatively connected between parallel upwardly projecting plate portions la of the support frame 1 and a riser 6. The riser 6 is also connected to the proximate end portion of a telescopic boom assembly 7 having a work platform 8 mounted on the distal end thereof.

The articulated parallelogram boom assembly 5 includes a lower boom assembly having pairs of parallel, laterally spaced compression and tension arms 9 and 10, respectively, extending between the support frame 1 and a floating frame 11. The compression and tensions arms 9 and 10 are pivotally connected to the support frame 1 as at 12 and 13, respectively, and to the floating frame as at 14 and 15, respectively. As shown in FIG. 1, in the retracted position, the compression and tension arms 9 and 10 extend downwardly from the frame 1 to the floating frame 11.

The articulated parallelogram boom assembly 5 also includes an upper boom assembly having a pair of parallel, laterally spaced compression arms 16 and a tubular tension arm 17 extending between the riser 6 and the floating frame 11. The compression arms 16 and the tubular tension arm 17 are pivotally connected to the riser 6 as at 18 and 19, respectively, and to the floating frame 11 as at 20*a* and 20*b*, respectively. As shown in FIG. 1, in the retracted position, the compression arms 16 and the tubular tension arm 17 extend downwardly from the floating frame 11 to the riser 6.

An extensible hydraulic cylinder 21, positioned on the centerline of the frame 1, is pivotally connected as at 22 to and between the lower compression arms 9, and as at 23 to and between side walls of the tubular tension arm 17. FIG. 5 illustrates a planar bottom view of the tubular tension arm 17. As shown, the tubular tension arm 17 has a hole 42 formed in a bottom wall thereof. The hole 42 accommodates the hydraulic cylinder 21 such that the rod of the hydraulic cylinder 21 extends up into the tubular tension arm 17, and is pinned to the side walls of the tubular tension arm 17. As further shown in FIGS. 1, 2, 4 and 5, two pairs of reinforcement plates 40 are attached to and project downwardly from the tubular tension arm 17. As discussed in more detail below, the reinforcement plates 40 serve as pivot mounting points 44 for a pair of tension links 33.

Figure 2:
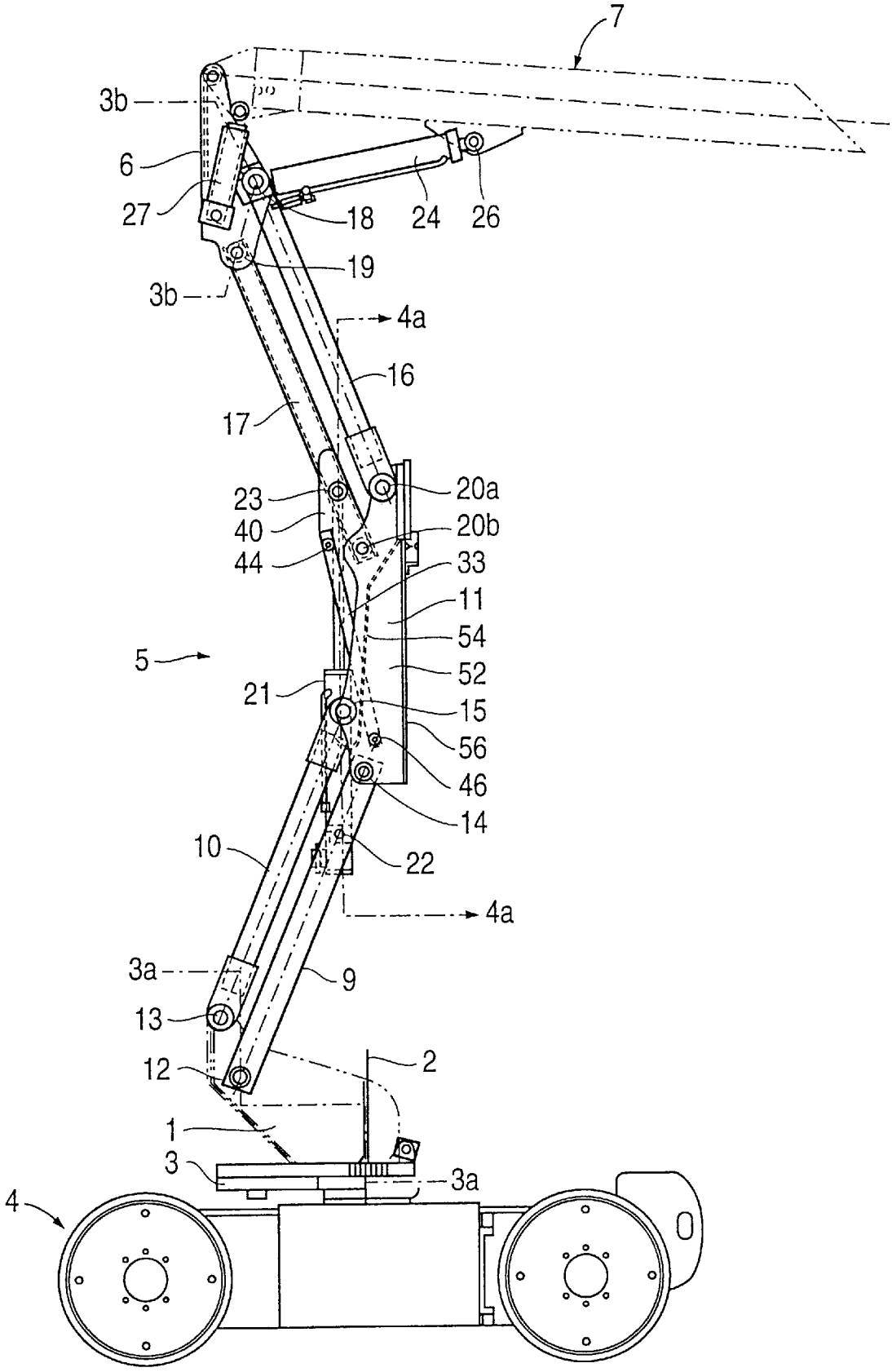
FIG. 2 is a side elevational view showing the double parallelogram riser assembly in an extended raised position.

As shown in FIGS. 1 and 2, the hydraulic cylinder 21 is pinned at 22 and at 23 on the longitudinal center lines of the lower compression arms 9 and the tubular tension arm 17, respectively. When the hydraulic cylinder 21 is retracted, the articulated parallelogram boom assembly 5 is in the folded position, as shown in FIG. 1, and is in the elevated position, as shown in FIG. 2, when the hydraulic cylinder 21 is extended. Throughout the range of motion of the articulated parallelogram boom assembly 5, the hydraulic cylinder 21 remains vertical.

A boom lift cylinder 24 is also pivotally connected along the centerline of the frame 1, above the hydraulic cylinder 21, between the riser 6, as at 18, and the telescopic boom assembly 7, as at 26. Accordingly, the boom lift cylinder 24 and the compression arms 16 share a common pivot point 18. The remaining components on the telescopic boom assembly 7 are conventional and include a master hydraulic cylinder 27 for controlling a slave cylinder 28 on the distal end of the telescopic boom assembly 7 which, together, maintain the work platform 8 in a horizontal position during the raising and lowering of the articulated parallelogram boom assembly 5 and the luffing of the telescopic boom assembly 7 with boom lift cylinder 24. In the folded or retracted position of the articulated parallelogram boom assembly 5, the hydraulic cylinder 21 is nested between the pairs of arms 9 and 10, and the boom lift cylinder 24 is nested between the compression arms 16, above the hydraulic cylinder 21. Both the master cylinder 27 and the cylinder for telescoping the telescopic boom assembly 7 are also disposed along the centerline of the frame 1.

Figure 3A:
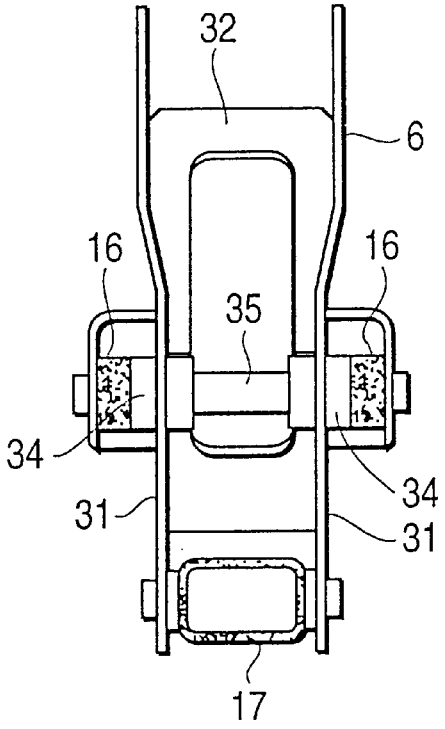
FIGS. 3*a* and 3*b* illustrate cross-sections of the articulated parallelogram boom assembly along lines 3*a*—3*a* and 3*b*—3*b* in FIG. 2.
Figure 3B:
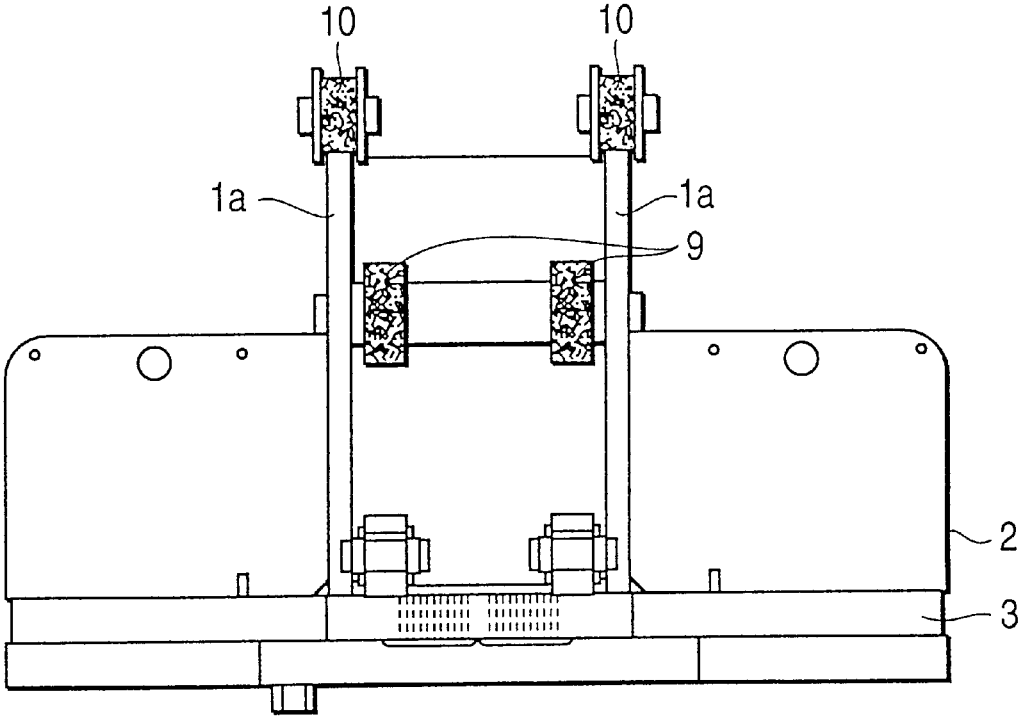

FIGS. 3*a* and 3*b* illustrate cross-sections of the parallelogram boom assembly 5 along lines 3*a*—3*a* and 3*b*—3*b* in FIG. 2. As shown in FIG. 3*a*, the riser 6 is formed from parallel plates 31 and a transverse plate 32. The tubular tension arm 17 is disposed between the parallel plates 31, and sidewalls of the tubular tension arm 17,are pinned to lower portions of the parallel plates 31 extending below the transverse plate 32. A pivot pin 35 pivotally attaches the compression arms 16 to the riser 6 with a boss 34 between each compression arm 16 and plate 31 such that the parallel plates 31 are disposed between the compression arms 16.

Figure 7:
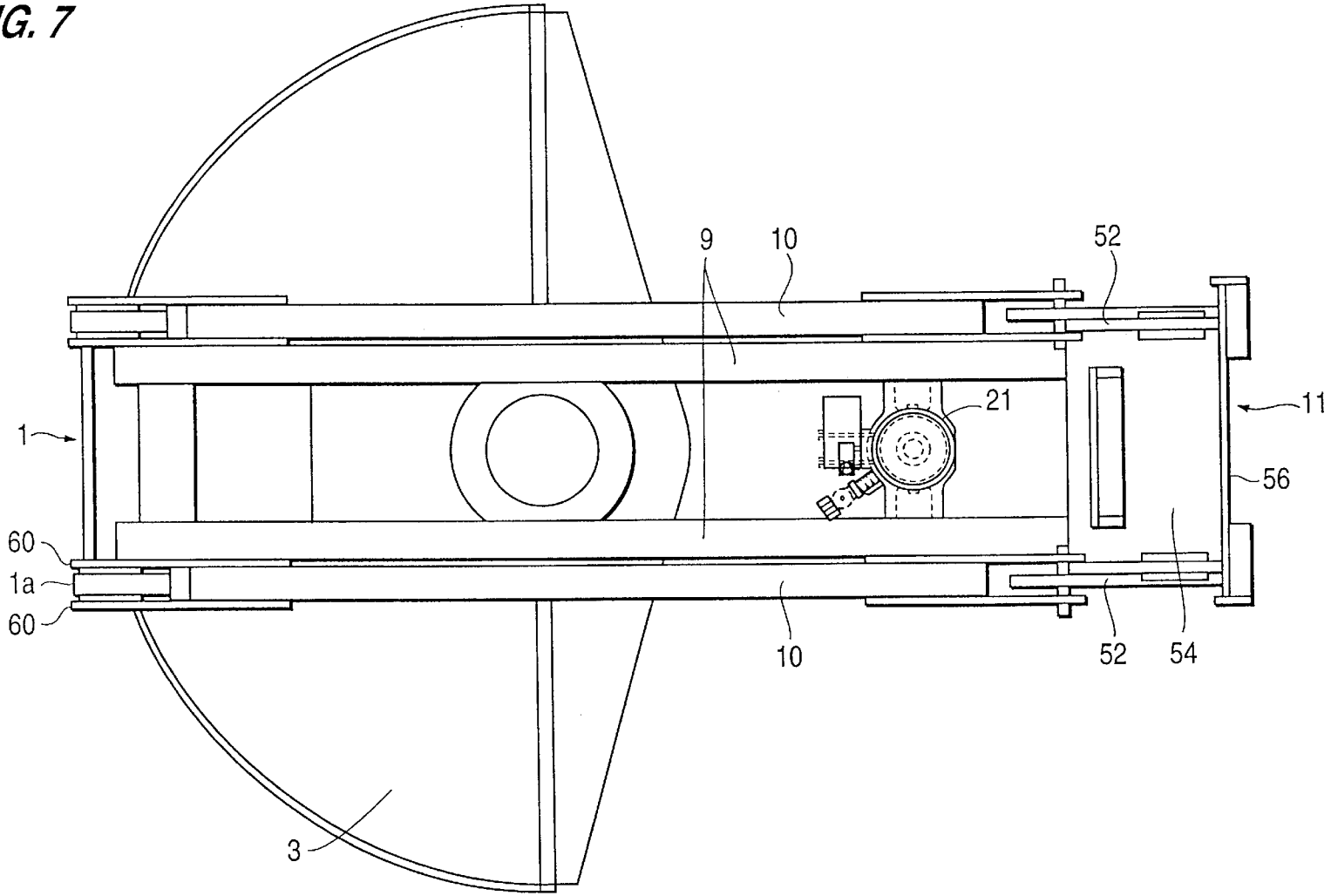
FIG. 7 illustrates a top view of the lower boom assembly of the articulated parallelogram boom assembly.

As shown in FIG. 3*b*, the support frame 1 includes upwardly projecting plate portions 1*a* to which both pairs of the compression and tension arms 9 and 10 are pivotally attached. The compression arms 9 are pinned to the inside of a respective one of the plate portions 1*a*. The tension arms 10 each have lugs 60 attached thereto forming a fork between which a respective plate portion 1*a* is pinned. FIG. 7 illustrates a top view of the lower boom assembly of the articulated parallelogram boom assembly 5, and shows the pivot connections between the tension arms 10 and the plate portions 1*a*. Consequently, the tension arms 10 are disposed further apart from one another than the compression arms 9.

As shown in FIGS. 3*a* and 3*b*, the parallel plates 31 of the riser 6 are spaced apart a smaller distance than the parallel plate portions 1*a* of the frame 1. As shown in FIG. 1, this arrangement permits the tubular tension arm 17 connected to the parallel plates 31 to nest between the tension arms 10, and when nested, the pivot point 19 for the tubular tension arm 17 is disposed below the pivot point 13 for the tension arms 10. As further shown in FIGS. 3*a* and 3*b*, the pair of compression arms 16, the pair of tension arms 10, and the pair of compression arms 9 are spaced apart substantially the same distance to provide a very stable parallelogram assembly. Because of the stable parallelogram assembly of the lower boom assembly, the floating frame 11 is maintained in a vertical orientation throughout the range of motion of the articulated parallelogram boom assembly 5.

Figure 4A:
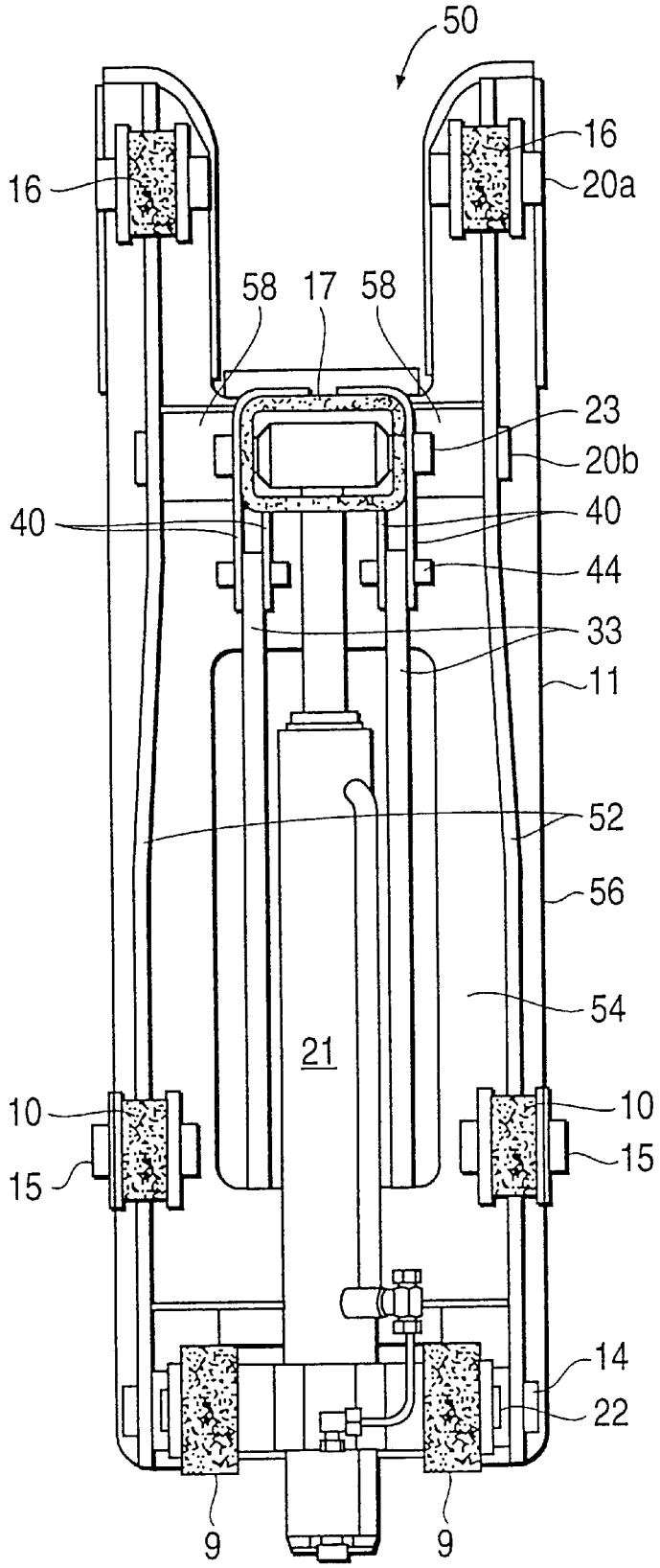
FIG. 4*a* illustrates a cross-section of the articulated parallelogram boom assembly viewed in the direction of arrows 4*a*—4*a* in FIG. 2.
Figure 4B:
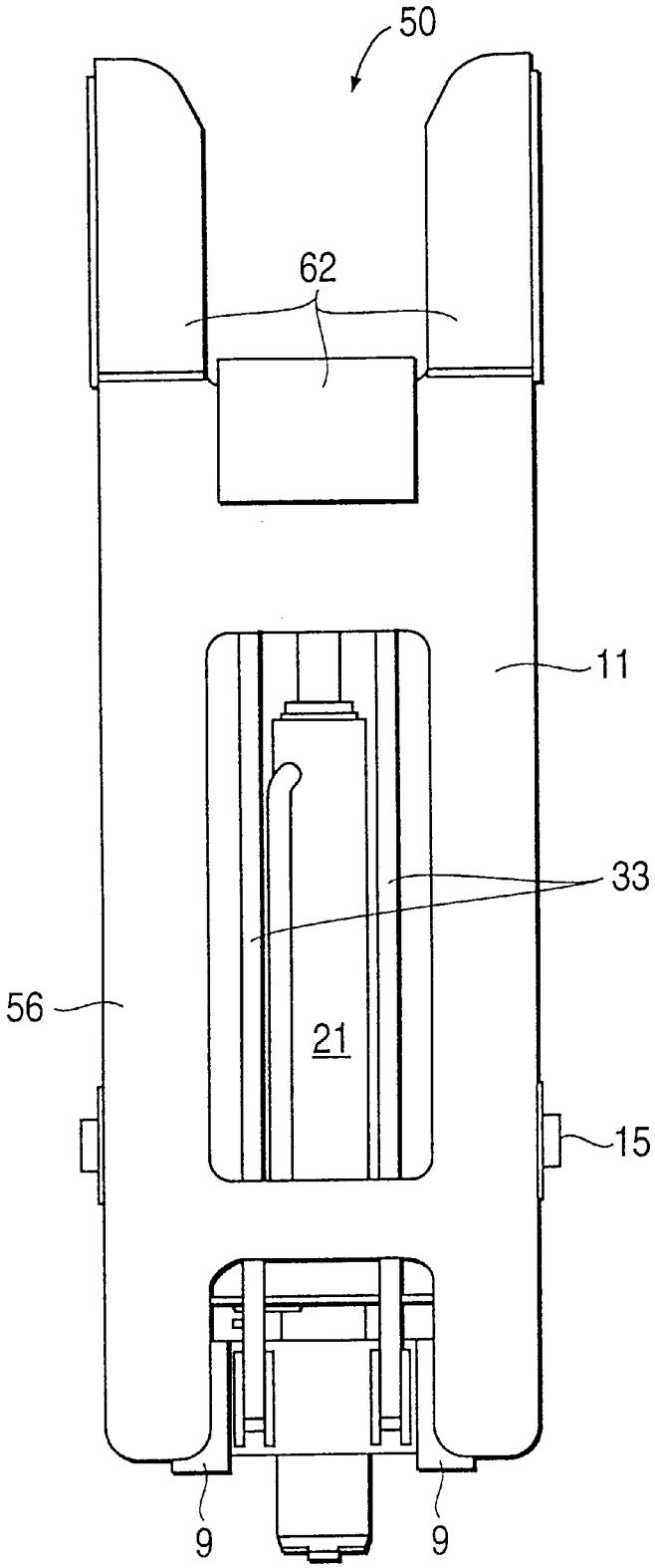
FIG. 4*b* illustrates the opposite side of the floating frame of the articulated parallelogram boom assembly as compared to FIG. 4*a;*
Figure 5:
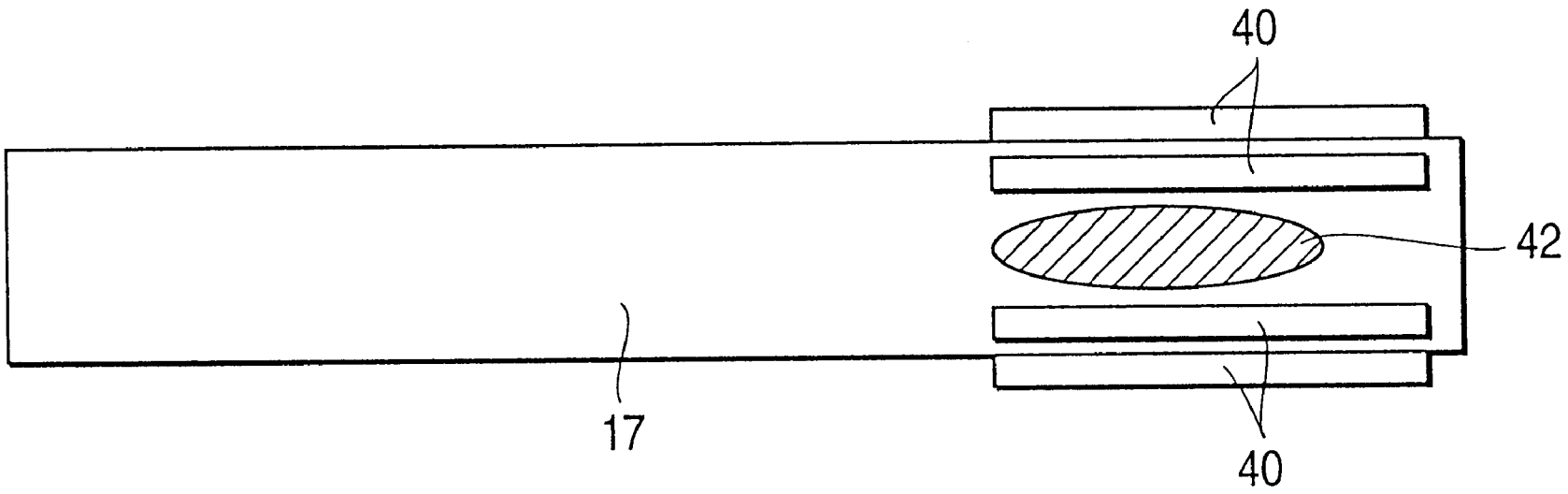
FIG. 5 illustrates a planar bottom view of the tubular tension arm in the upper boom assembly of the articulated parallelogram boom assembly.
Figure 6:
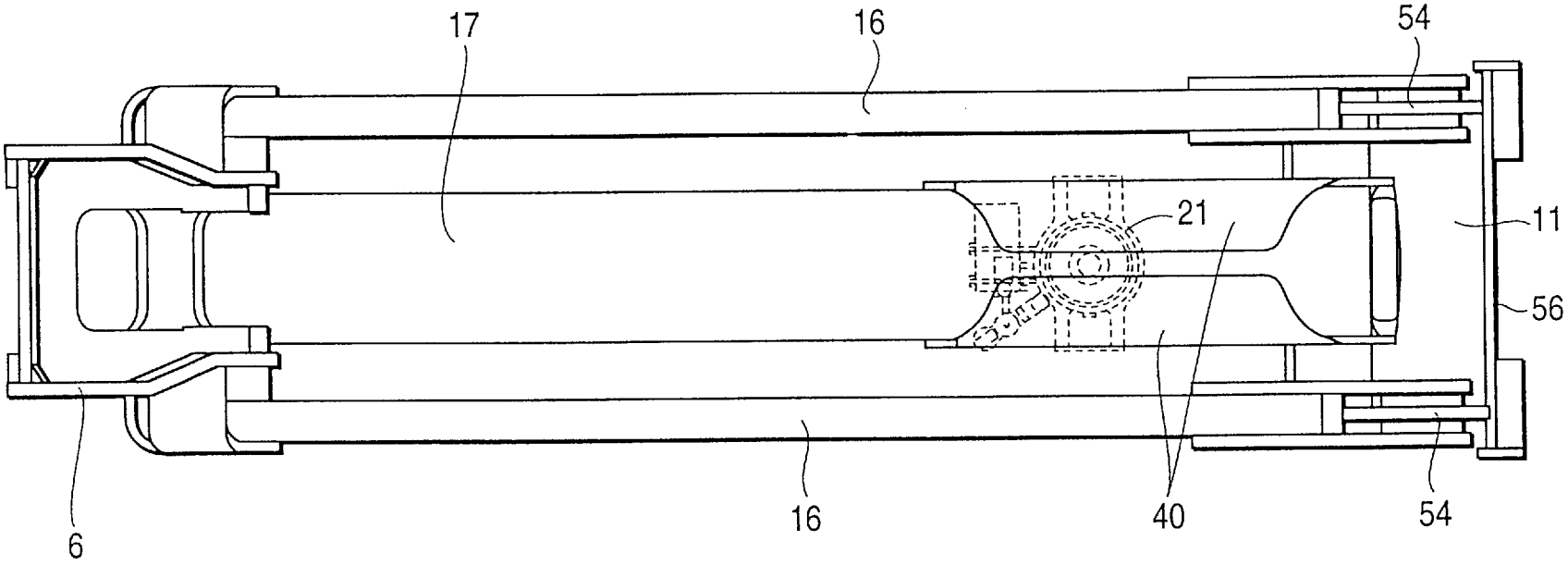
FIG. 6 illustrates a top view of the upper boom assembly of the articulated parallelogram boom assembly.

FIG. 4*a* illustrates a cross-section view of the articulated parallelogram boom assembly 5 looking in the direction of arrows 4*a*—4*a*, and FIG. 4*b* illustrates the opposite side of the floating frame 11 as compared to FIG. 4*a*. As shown, the floating frame 11 is formed from parallel plates 52 and transverse plates 54 and 56 (see also FIG. 2). The compression arms 9 are pinned to a respective plate 52. The tension arms 10 and the compression arms 16 each have lugs attached thereto forming a fork between which a respective plate 52 is pinned. FIG. 6 illustrates a top down view of the upper boom assembly of the articulated parallelogram assembly 5, and shows the pivot connections between the compression arms 16 and the floating frame 11. FIG. 7 shows the pivot connections between the tension arms 10 and the floating frame 11 (see also FIG. 2). The tubular tension arm 17 is pinned between plates 52. Specifically, a cylindrical housing 58 passes through the side walls of the tubular tension arm 17, and the cylindrical housing 58 is pinned to the plates 52.

Figure 8:
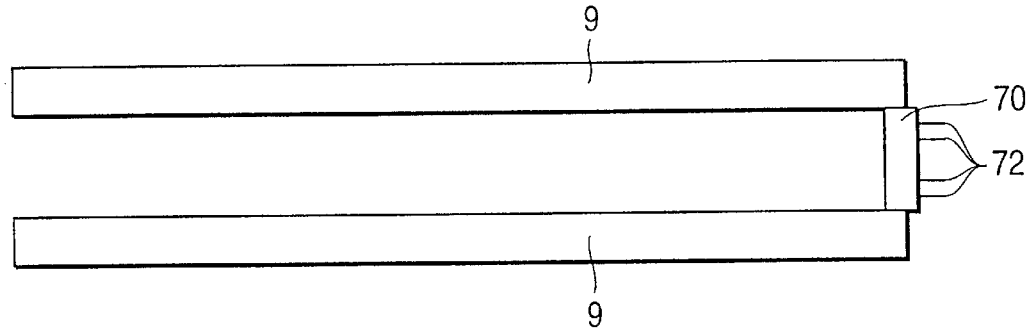
FIG. 8 illustrates a top down view of the compression arms in the lower boom assembly of the articulated parallelogram boom assembly.

As further shown in FIGS. 4*a* and 4*b*, the links 33 extend diagonally down from the two pairs of parallel reinforcement plates 40 through a hole in the transverse plate 54, and, as shown in FIG. 2, attach to the end of the compression arms 9 at pivot point 46. FIG. 8 illustrates a top down view of the compression arms 9. As shown, at the floating frame 11 end of the compression arms 9, the compression arms 9 have a block 70 welded therebetween. Two pairs of lugs 72 extend from the block 70, and form forks between which a respective one of the links 33 is pinned as at 46 in FIGS. 1 and 2. The pivot point 46 lies in a plane formed between respective extensions of the longitudinal center lines of the compression arms 9.

Furthermore, FIG. 4*b* shows a slot section 50 formed in the upper portion of the floating frame 11. The slot section 50 accommodates the telescopic boom assembly 7 in the retracted position as shown in FIG. 1. Consequently, the telescopic boom assembly 7 slopes downwardly from the riser 6 in the retracted position. As shown in FIG. 4*b*, three guide blocks 62 (e.g., wear pads), for guiding the telescopic boom assembly 7 to the retracted position, are disposed about the slot section 50.

As discussed above, each link 33 is pivotally connected to one of the reinforcing plates 40 as at 44. The pivot point 44 is disposed further from the floating frame 11 than the pivot point 20*b* for the tubular tension arm 17. Each link 33 is further pivotally connected to a respective compression arm 9 as at 46.

By this construction and arrangement, the links 33 extend diagonally relative to the pivotal connections 14 and 20*b*, so that the link pivot connection 44 is on one side of the compression arm 16 pivot connection 20*b*, and the link pivot connection 46 is on the other side of the compression arm 9 pivot connection 14; whereby, during the actuation of the hydraulic cylinder 21 to pivot the compression arms 9 and 16 relative to each other, the links 33 will synchronize the movement of the upper parallelogram assembly relative to the lower parallelogram assembly.

Specifically, in the retracted position, the perpendicular moment arm at the lower boom assembly of the articulated parallelogram boom assembly 5 (i.e., the distance, measured perpendicularly, between a line passing through the longitudinal axis of the link 33 including the pivot point 46 and a line parallel thereto passing through the pivot point 14) is substantially larger than the perpendicular moment arm for the upper boom assembly (i.e., the distance, measured perpendicularly, between a line passing through the longitudinal axis of the link 33 and the pivot point 44 and a line parallel thereto passing through the pivot point 20*b*).

As the articulated parallelogram boom assembly 5 extends, the perpendicular moment arms for the lower and upper boom assemblies gradually become equal at about the point when the lower and upper boom assemblies are parallel, and then the perpendicular moment arm for the upper boom assembly becomes larger than the perpendicular moment arm for the lower boom assembly. At the fully extended position, the perpendicular moment arm of the upper boom assembly is substantially larger than the perpendicular moment arm of the lower boom assembly by about the same margin that the perpendicular moment arm of the lower boom assembly exceeded the perpendicular moment arm of the upper boom assembly in the retracted position. In a preferred embodiment the perpendicular moment arms of the upper and lower boom assemblies are 69.12 mm and 114.04 mm in the retracted position, 107.64 mm and 123.59 mm in the parallel position, and 113.88 mm and 68.03 mm in the fully extended position. The above values are given by way of example only, and in no way limit the possible perpendicular moment arm values of the present invention.

Disposing the hydraulic cylinder 21 vertically between the compression arms 9 and the tubular tension arm 17, permits the compression and tension arms 9 and 10 to slope downwardly from the frame 1 in the retracted position, and permits the compression arms 16 and the tubular tension arm 17 to slope downwardly from the floating frame 11 in the retracted position. Additionally, the slot section 50 in the floating frame 11 permits the telescopic boom assembly 7 to slope downwardly from the riser 6 in the retracted position. As a result, the height of the frame 1, the length of the floating frame 11, and the length of the riser 6 can be increased without increasing the overall retracted height of the machine. Accordingly, the highest point of the machine in the retracted position is approximately six feet, six inches or less. As one skilled in the art will realize, however, the overall dimensions of the machine could be increased or decreased.

Figure 9:
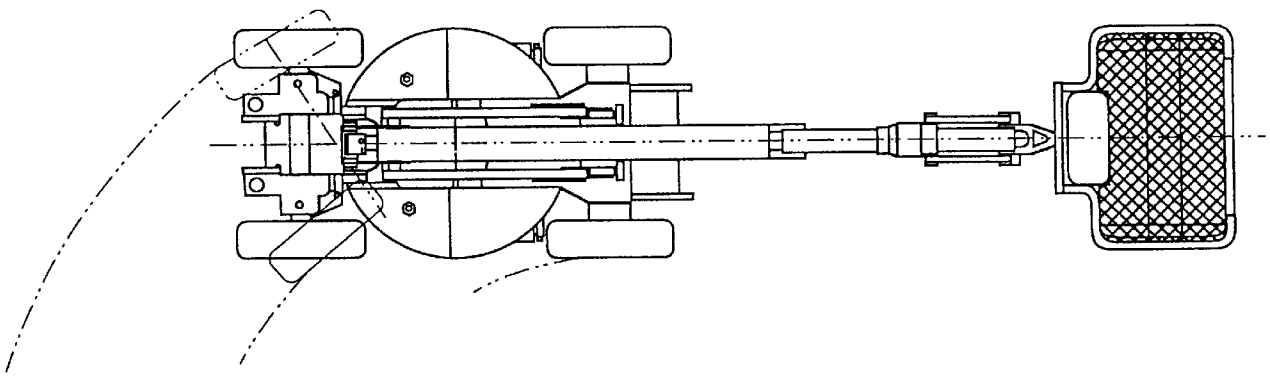
FIG. 9 illustrates a top down view of the aerial work platform according to an embodiment of the present invention.

The increased height of the frame 1, the increased length of the floating frame 11, and the increased length of the riser 6 provides for at least a first and/or second advantage. The first advantage is an increase in the working height that the machine can achieve. The second advantage is a decrease in the length of the telescopic boom assembly 7 and/or the length of the articulated parallelogram boom assembly 5 without a decrease in the working height as compared to conventional aerial work platforms. As a result, an aerial work platform with no tail swing and minimal front swing is produced without a decrease in working height as compared to conventional aerial work platforms. FIG. 9 illustrates a top view of the aerial work platform according to the present invention. As FIGS. 2 and 9 show, the aerial work platform according to the present invention has no tail swing and minimal front swing. Depending on desired operating characteristics, one skilled in the art can balance the increased working height versus reduced front swing trade-off to meet those characteristics.

Furthermore, as FIGS. 1–2, 6–7, and particularly FIG. 9 show, the longitudinal axes of the articulated parallelogram boom assembly 5, the hydraulic lift cylinder 21, the telescopic boom assembly 7, and the boom lift cylinder 24 lie within the same vertical plane (i.e., are in-line).

The positioning of the hydraulic cylinder 21 in cooperation with the links 33 sets up a lift geometry which minimizes the loads on both the hydraulic cylinder 21 and the links 33, and maintains the loads on the hydraulic cylinder 21 and the links 33 substantially constant over the range of motion of the articulated parallelogram boom assembly 5.

The load on the hydraulic cylinder 21 could be reduced by positioning the hydraulic cylinder 21 closer to the frame 1. Doing so, however, presents a clearance problem with the bottom of the hydraulic cylinder 21. Accordingly, the length of the hydraulic cylinder 21 would have to be decreased; thus, decreasing the maximum possible working height of the machine. Depending on desired operating characteristics one skilled in the art can balance the load versus maximum working height trade-off to meet those characteristics.

Additionally, the rod of the hydraulic cylinder 21 could be pinned between the compression arms 16. This would require forming a larger version of hole 42, and forming a similar hole in the top of the tubular tension arm 17 to accommodate the cylinder portion of the hydraulic cylinder 21. To make such an accommodation would require increasing the width of the tubular tension arm 17 with the resulting ripple effect being an overall increase in the width of the articulated parallelogram boom assembly 5.

As a further note, the articulated parallelogram boom assembly 5 may be applied to devices other than self propelled aerial work platforms without departing from the spirit and scope of the present invention.

While the invention has been described in connection with what is presently considered the most practical and preferred embodiments, it is to be understood that the invention is not limited to the disclosed embodiments, but on the contrary, is intended to cover various modifications and equivalent arrangements included within the spirit and scope of the appended claims.

What is claimed is:

1. A lift apparatus, comprising:

a superstructure frame support;

a riser; and an articulated parallelogram boom assembly operatively connected between said superstructure frame support and said riser, said articulated parallelogram boom assembly including, a floating frame, a lower parallelogram boom assembly operationally connected between said superstructure frame support and said floating frame, said lower parallelogram boom assembly sloping downward from said superstructure frame support to said floating frame when said articulated parallelogram boom assembly is fully lowered, an upper parallelogram boom assembly operationally connected between said floating frame and said riser, said upper parallelogram boom assembly having a first longitudinal axis as measured from said riser and said lower parallelogram boom assembly having a second longitudinal axis, said first and second longitudinal axes lying within a same vertical plane, and first lift means for raising and lowering said articulated parallelogram boom assembly.

2. The lift apparatus of claim 1, wherein said upper parallelogram boom assembly slopes downward from said floating frame to said riser when said articulated parallelogram boom assembly is fully lowered.

3. The lift apparatus of claim 2, wherein a portion of said upper parallelogram boom assembly nests within said lower parallelogram boom assembly when said articulated parallelogram boom assembly is fully lowered.

4. The lift apparatus of claim 1, further comprising:

a telescopic boom connected to said riser; and second lift means for raising and lowering said telescopic boom.

5. The lift apparatus of claim 4, wherein:

said second lift means includes a lift cylinder connected between said riser and said telescopic boom, said lift cylinder nesting within said upper parallelogram boom assembly when said articulated parallelogram boom assembly is fully lowered and said telescopic boom is fully lowered.

6. The lift apparatus of claim 4, wherein said floating frame includes a notch in an upper portion thereof, and said telescopic boom seats in said notch when said articulated parallelogram boom assembly is fully lowered and said telescopic boom is fully lowered.

7. The lift apparatus of claim 6, wherein said telescopic boom partially nests within said upper parallelogram boom assembly when said articulated parallelogram boom assembly is fully lowered and said telescopic boom is fully lowered.

8. The lift apparatus of claim 4, wherein said parallelogram partially nests within said upper telescopic boom assembly when said articulated parallelogram boom assembly is fully lowered and said telescopic boom is fully lowered.

9. The lift apparatus of claim 4, wherein said second lift means includes a lift cylinder connected between said riser and said telescopic boom, and said lift cylinder, said telescopic boom, said upper parallelogram boom assembly and said lower parallelogram boom assembly each have a longitudinal axis lying within a same plane.

10. The lift apparatus of claim 4, wherein said telescopic boom, said upper parallelogram boom assembly and said lower parallelogram boom assembly each have a longitudinal axis lying within a same plane.

11. The lift apparatus of claim 1, wherein said first lift means includes a lift cylinder connected between said upper parallelogram boom assembly and said lower parallelogram boom assembly.

12. The lift apparatus of claim 11, wherein said lift cylinder, said upper parallelogram boom assembly and said lower parallelogram boom assembly each have a longitudinal axis lying within a same plane.

13. The lift apparatus of claim 1, wherein said lower parallelogram boom assembly includes a pair of parallel, laterally spaced first compression arms and a pair of parallel, laterally spaced first tension arms, said first compression and tension arms forming a parallelogram assembly, said first compression and tension arms pivotally connected at one end to said superstructure frame support and pivotally connected at another end to said floating frame; and said upper parallelogram boom assembly includes a pair of parallel, laterally spaced second compression arms and a tubular second tension arm, said second compression arms and said second tension arm forming a parallelogram assembly, said second compression and tension arms pivotally connected at one end to said floating frame and pivotally connected at another end to said riser.

14. The lift apparatus of claim 13, wherein said second tension arm partially nests within said first tension arms when said articulated parallelogram boom assembly is fully lowered.

15. The lift apparatus of claim 13, wherein said first lift means includes a lift cylinder, said lift cylinder includes a first and second end, said first end is connected to said first compression arms and said second end is connected to said second tension arm.

16. The lift apparatus of claim 13, wherein said lift means includes a lift cylinder, said lift cylinder includes a first end and a second end, said first end is connected to said first compression arms and said second end is connected to said second compression arms.

17. The lift apparatus of claim 1, wherein said riser partially nests within said lower parallelogram boom assembly when said articulated parallelogram boom assembly is fully lowered.

18. The lift apparatus of claim 1, further comprising:

synchronization linkage extending through said floating frame, connected at a first end to said upper parallelogram boom assembly, connected at a second end to said lower parallelogram boom assembly, and synchronizing movement of said upper parallelogram boom assembly relative to said lower parallelogram boom assembly.

19. The lift apparatus of claim 18, wherein said lift means and said synchronization linkage set up a lift geometry which maintains loads on said lift means and said synchronization linkage substantially constant over a range of motion of said articulated parallelogram boom assembly.

20. The lift apparatus of claim 1, wherein said floating frame remains vertical over a range of motion of said articulated parallelogram boom assembly.

21. The lift apparatus of claim 1, further comprising:

a work platform operationally connected to said articulated parallelogram boom assembly.

22. The lift apparatus of claim 21, further comprising:

a telescopic boom connected between said riser and said work platform.

23. A lift apparatus, comprising:

a superstructure frame support;

a riser; and an articulated parallelogram boom assembly operatively connected between said superstructure frame support and said riser, said articulated parallelogram boom assembly including, a floating frame, a lower parallelogram boom assembly operationally connected between said superstructure frame support and said floating frame, an upper parallelogram boom assembly operationally connected between said floating frame and said riser, said upper parallelogram boom assembly sloping downward from said floating frame to said riser when said articulated parallelogram boom assembly is fully lowered, said upper parallelogram boom assembly having a first longitudinal axis as measured from said riser and said lower parallelogram boom assembly having a second longitudinal axis, said first and second longitudinal axes lying within a same vertical plane, and first lift means for raising and lowering said articulated parallelogram boom assembly.

24. The lift apparatus of claim 23, wherein a portion of said upper parallelogram boom assembly nests within said lower parallelogram boom assembly when said articulated, parallelogram boom assembly is fully lowered.

25. The lift apparatus of claim 23, further comprising:

a telescopic boom connected to said riser;

second lift means for raising and lowering said telescopic boom; and wherein said floating frame includes a notch in an upper portion thereof, and said telescopic boom seats in said notch when said articulated parallelogram boom assembly is fully lowered and said telescopic boom is fully lowered.

26. The lift apparatus of claim 23, further comprising:

a work platform operationally connected to said articulated parallelogram boom assembly.

27. The lift apparatus of claim 26, further comprising:

a telescopic boom connected between said riser and said work platform.

28. A lift apparatus, comprising:

a superstructure frame support;

a riser; and an articulated parallelogram boom assembly operatively connected between said superstructure frame support and said riser, said articulated parallelogram boom assembly including, a floating frame, a lower parallelogram boom assembly operationally connected between said superstructure frame support and said floating frame, an upper parallelogram boom assembly operationally connected between said floating frame and said riser, and a lift cylinder raising and lowering said articulated parallelogram boom assembly and connected between said upper parallelogram boom assembly and said lower parallelogram boom assembly, said lift cylinder remaining vertically oriented with respect to said superstructure frame support over essentially the entire range of motion of said articulated parallelogram boom assembly.

29. The lift apparatus of claim 28, wherein said lower parallelogram boom assembly includes a pair of parallel, laterally spaced first compression arms and a pair of parallel, laterally spaced first tension arms, said first compression and tension arms forming a parallelogram assembly, said first compression and tension arms pivotally connected at one end to said superstructure frame support and pivotally connected at another end to said floating frame; and said upper parallelogram boom assembly includes a pair of parallel, laterally spaced second compression arms and a tubular second tension arm, said second compression arms and said second tension arm forming a parallelogram assembly, said second compression and tension arms pivotally connected at one end to said floating frame and pivotally connected at another end to said riser.

30. The lift apparatus of claim 29, wherein said lift cylinder includes a first and second end, said first end connected to said first compression arms and said second end connected to said second tension arm.

31. The lift apparatus of claim 29, wherein said lift cylinder includes a first end and a second end, said first end connected to said first compression arms and said second end connected to said second compression arms.

32. The lift apparatus of claim 28, wherein said lower parallelogram boom assembly slopes downward from said superstructure frame support to said floating frame when said articulated parallelogram boom assembly is fully lowered.

33. The lift apparatus of claim 32, wherein said upper parallelogram boom assembly slopes downward from said floating frame to said riser when said articulated parallelogram boom assembly is fully lowered.

34. The lift apparatus of claim 28, wherein said upper parallelogram boom assembly slopes downward from said floating frame to said riser when said articulated parallelogram boom assembly is fully lowered.

35. The lift apparatus of claim 28, further comprising:

a work platform operationally connected to said articulated parallelogram boom assembly.

36. The lift apparatus of claim 35, further comprising:

a telescopic boom connected between said riser and said work platform.

* * * * *